US008696310B2

(12) United States Patent
Dillon et al.

(10) Patent No.: US 8,696,310 B2
(45) Date of Patent: Apr. 15, 2014

(54) TURBO CHARGER HOUSING

(75) Inventors: Ryan Gabriel Dillon, Portland, OR (US); James Jacob deGlee, Portland, OR (US); Robert C. Edstrom, Portland, OR (US)

(73) Assignee: Consolidated Metco, Inc., Vancouver, WA (US)

( * ) Notice: Subject to any disclaimer, the term of this patent is extended or adjusted under 35 U.S.C. 154(b) by 571 days.

(21) Appl. No.: 13/124,835

(22) PCT Filed: Nov. 7, 2008

(86) PCT No.: PCT/US2008/082839
§ 371 (c)(1),
(2), (4) Date: Apr. 18, 2011

(87) PCT Pub. No.: WO2010/053491
PCT Pub. Date: May 14, 2010

(65) Prior Publication Data

US 2011/0217162 A1 Sep. 8, 2011

(51) Int. Cl.
*F01D 25/28* (2006.01)

(52) U.S. Cl.
USPC ..... 415/206; 415/214.1

(58) Field of Classification Search
USPC ..... 415/214.1, 215.1, 203, 204, 206, 144; 29/888.02, 889.2, 525
See application file for complete search history.

(56) References Cited

U.S. PATENT DOCUMENTS

| | | | | |
|---|---|---|---|---|
| 4,676,717 | A | 6/1987 | Willyard, Jr. et al. | |
| 4,691,423 | A | 9/1987 | Willyard, Jr. et al. | |
| 5,207,565 | A | 5/1993 | Roessler | |
| 5,246,335 | A * | 9/1993 | Mitsubori et al. | 415/58.3 |
| 6,193,463 | B1 * | 2/2001 | Adeff et al. | 415/196 |
| 7,001,148 | B2 | 2/2006 | Cardenas et al. | |
| 7,086,833 | B2 | 8/2006 | Cvjeticanin et al. | |
| 7,179,051 | B2 | 2/2007 | Williams et al. | |
| 2002/0106278 | A1 | 8/2002 | Koga | |

FOREIGN PATENT DOCUMENTS

| | | | |
|---|---|---|---|
| JP | 10252696 | A | 9/1998 |
| JP | 1248597 | A | 9/2001 |
| KR | 10-2002-0031409 | | 5/2002 |
| WO | WO 2010/053491 | A1 | 5/2010 |

OTHER PUBLICATIONS

International Search Report and Written Opinion dated Aug. 4, 2009, issued in corresponding European Patent Application No. WO 2010/053491 A1, published May 14, 2010.

* cited by examiner

*Primary Examiner* — Edward Look
*Assistant Examiner* — Juan G Flores
(74) *Attorney, Agent, or Firm* — Klarquist Sparkman, LLP

(57) ABSTRACT

A turbocharger compressor housing apparatus comprises a compressor housing and diffuser. These components are configured to provide an interference fit when assembled. An annular projection extends outwardly from one of such components toward the other of the components and engages the other of the components to form an annular joint. One of the compressor housing and diffuser comprises a recess positioned to collect debris generated during the interference fit to prevent the debris from reaching the annular joint. A second recess can be provided at the opposite side of the projection to accommodate deformation of the projection during assembly of the diffuser and compressor housing. The recesses can be annular and can, along with the projection, be included in the diffuser.

29 Claims, 10 Drawing Sheets

TURBO CHARGER HOUSING

CROSS REFERENCE TO RELATED APPLICATIONS

This is the U.S. National Stage of International Application No. PCT/US2008/082839, filed Nov. 7, 2008, which was published in English under PCT Article 21(2), and which is incorporated herein in its entirety.

FIELD

This disclosure relates to turbocharger compressor housings and more specifically to such housings comprising a compressor housing and a diffuser.

BACKGROUND

A known turbocharger compressor housing comprises a compressor housing and a diffuser that is press fit into a sleeve portion of the compressor housing. An impeller moves air through the diffuser and into the compressor housing.

FIGS. 2A-2C illustrate a prior art turbocharger compressor housing having a longitudinal axis 106 and comprising a compressor housing 102 and a diffuser 104. The compressor housing 102 comprises an interior wall 105 with a sleeve portion 108 having a cylindrical wall surface 109 that is sized to receive a cylindrical insert portion 110 of the diffuser. The cross-sectional dimension of sleeve portion 108 in the region of surface 109 is sized to be slightly less than the cross sectional dimension of a wall surface portion 112 of the insert portion 110 of the diffuser. As a result, when these components are pressed together, an interference fit, indicated at 114 in FIG. 2C, is provided that extends about the entire periphery of the insert 110. FIG. 2C illustrates this prior art construction with the insert portion of the diffuser 104 shown in a fully inserted position into the compressor housing 102. When in this position, a clearance gap 117 is provided between a sloping wall surface 116 of compressor housing 102 and a sloping wall surface 118 of diffuser 104. Also, as can be seen in FIG. 2A, compressor housing 102 is provided with an annular surface 120 that acts as a stop by engaging an annular surface 124 of the diffuser 104 to limit the extent the diffuser is inserted into the compressor housing.

With this construction, a low pressure area 130 exists at the air entry side of the diffuser. In contrast, high pressure areas 132, 134, at a higher pressure than the low pressure area, exist at a high pressure side of an impeller, thereby creating a pressure differential across the interference fit 114 which can result in pressure equalization leakage across the interference joint between the compressor housing and diffuser. Such leakage interferes with the efficiency of a turbocharger.

Therefore, a need exists for improved turbocharger compressor housings and related methods.

SUMMARY

In accordance with one embodiment, a turbocharger compressor housing apparatus comprises a compressor housing comprising a diffuser receiving opening bounded at least in part by a compressor housing wall that comprises a first mating surface. Desirably the compressor housing wall entirely surrounds the diffuser receiving opening. The diffuser receiving opening has an inlet through which a diffuser can be inserted into a sleeve or pocket portion of the diffuser receiving opening. A diffuser comprises an exterior diffuser wall that comprises a second mating surface, the exterior diffuser wall being sized and shaped for insertion into the diffuser receiving opening to a fully inserted position. The first and second mating surfaces are desirably configured to provide an interference fit of the compressor housing wall and the exterior diffuser wall at least when the exterior diffuser wall is inserted into the diffuser receiving opening to the fully inserted position. The diffuser has a distal end positioned within the diffuser receiving opening when the diffuser has been inserted in place. One of the compressor housing wall and the exterior diffuser wall comprises or includes an annular projection extending outwardly from the said one of the compressor housing wall and the exterior diffuser wall and toward the other of the compressor housing wall and the exterior diffuser wall. The annular projection can be of a variety of shapes, with an annular rib being one specific example. The projection can be positioned to engage the said other of the compressor housing wall and the exterior diffuser wall to form an annular joint between the projection and engaged said other of the compressor housing wall and exterior diffuser wall at least when the exterior diffuser wall is at the fully inserted position. As another aspect of this embodiment, one of the compressor housing wall and the exterior diffuser wall comprises a recess positioned adjacent to, and more desirably abutting or proximate to, a first side portion of the projection, the recess being nearer to the distal end portion than the first side portion of the projection and positioned to prevent debris generated by the interference fitting of the first and second mating surfaces from reaching the annular joint.

As another aspect of an embodiment, the said one of the compressor housing wall and the exterior diffuser wall can comprise a second recess positioned adjacent to a second side of the projection, the projection being positioned between the second recess and the distal end portion. The second recess can provide a space into which the projection can deform as the diffuser approaches the fully inserted position.

In specific exemplary embodiments, there is only one projection.

In accordance with an embodiment, the first and second recesses can be annular. As an alternative, the first recess can be of a plurality of discrete or interconnected recess segments positioned between the projection and interference fit area or areas of the components and spanning the interference fit area so as to block a direct path from the interference fit area in a direction parallel to the longitudinal axis of the diffuser to the projection. The first recess is desirably configured and positioned to collect debris generated by the interference fit at a location leading the projection as the diffuser is inserted into the compressor housing.

In accordance with an embodiment, the first and second mating surfaces can comprise cylindrical mating surfaces, such as right cylindrical mating surfaces. The term cylindrical and right cylindrical used herein means substantially cylindrical. That is, walls that slope relative to a longitudinal axis from zero degrees to five degrees are included within the meaning of cylindrical throughout this description and claims. The interference fitting mating surfaces can extend about the entire (360 degrees) periphery of engaged diffuser wall and compressor wall surfaces. Alternatively, discrete interference fitting areas can be used (e.g. three such areas spaced about the periphery of the diffuser).

In a particular embodiment, the said one of the compressor housing wall and the exterior diffuser housing wall is the exterior diffuser housing wall. Also, the projection, the first recess, and the second recess can all comprise portions of the exterior diffuser wall. These recesses can be annular.

As a more specific aspect of an embodiment, the compressor housing can comprise a longitudinal axis, the first mating surface comprising a right cylindrical mating surface portion of the compressor housing wall that is coaxial with the longitudinal axis, the compressor housing wall comprising an annular projection engaging wall portion adjacent to the diffuser receiving opening, the annular projection engaging wall portion having a first radius from the longitudinal axis at a first location adjacent to the diffuser receiving opening and a second radius from the longitudinal axis at a second location spaced further from the diffuser receiving opening than the first location, the second radius being greater than the first radius, the annular projection engaging wall portion having a first slope from the first location to the second location, wherein the diffuser comprises the projection and wherein the projection comprises an annular compressor housing wall engaging surface portion at a first side portion of the projection that has a second slope, the first side portion of the projection being nearest to the distal end, the compressor housing wall engaging surface portion of the projection engaging the projection engaging wall portion to form the annular joint at least when the exterior diffuser wall is at the fully inserted position. As a specific example, the second slope can differ by no more than plus or minus twenty-five degrees from the first slope. As another example, the second slope can be greater than the first slope. As a further example, the second slope is the same as the first slope. As yet another example, the first slope can be about forty-five degrees. In this last example, the term about includes slopes that are within plus or minus five degrees of forty-five degrees.

The diffuser is desirably press fit into the diffuser receiving opening with the projection being inserted into the diffuser receiving opening. In one embodiment, the diffuser is inserted into the diffuser receiving opening from 0.2 mm to 1 mm beyond the initial contact between a projection engaging wall portion of the compressor housing wall and a compressor housing wall engaging surface portion of the projection when the diffuser is at a fully inserted position. Although not precluded, desirably there are no o-ring seals between the diffuser and compressor housing. Stop and stop engaging features can be provided on the diffuser and compressor housing that engage one another to limit the extent of insertion of the projection into the diffuser receiving opening.

In accordance with an embodiment, the projection can be generally triangular in cross section with an apex of the triangle being spaced from the exterior diffuser wall. The apex can, in an embodiment, be truncated.

A method of engaging a turbocharger compressor housing and a diffuser can comprise: sliding the compressor housing and diffuser relative to one another to insert the diffuser into the compressor housing and to form an interference fit of the diffuser to the compressor housing; at least partially deforming an annular projection included in one of the compressor housing and diffuser during sliding of the compressor housing and diffuser relative to one another to form an annular joint between the housing and diffuser; and collecting debris generated during the interference fit and preventing the debris from reaching the annular joint. An embodiment of the method can further comprise collapsing at least a portion of the annular projection into an annular recess.

These and other features of embodiments of the invention will become more apparent from the following detailed description, which proceeds with reference to the accompanying figures.

DETAILED DESCRIPTION

Figure 1:
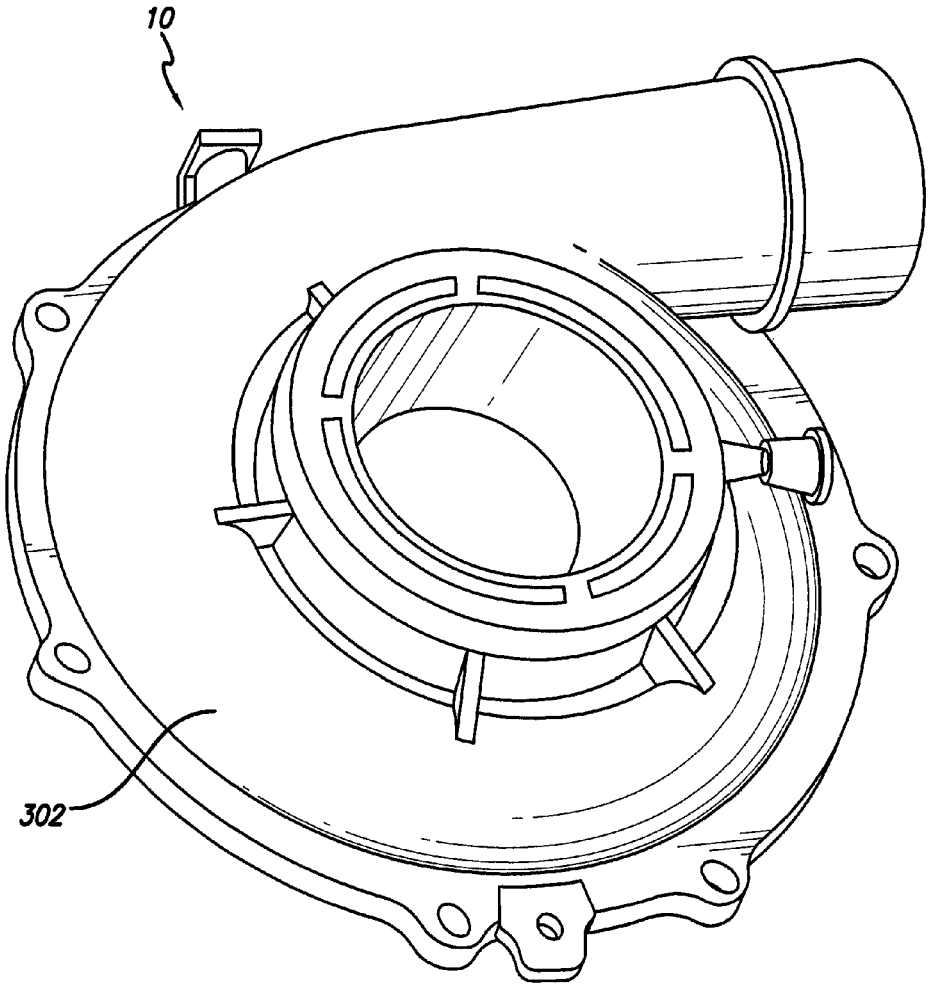
FIG. 1 is a perspective view of an embodiment of a turbocharger compressor housing having internal features as described below in connection with the embodiments of FIGS. 3-9.

FIG. 1 illustrates one form of a turbocharger compressor housing apparatus 10 in accordance with one embodiment of this disclosure.

Figure 3:
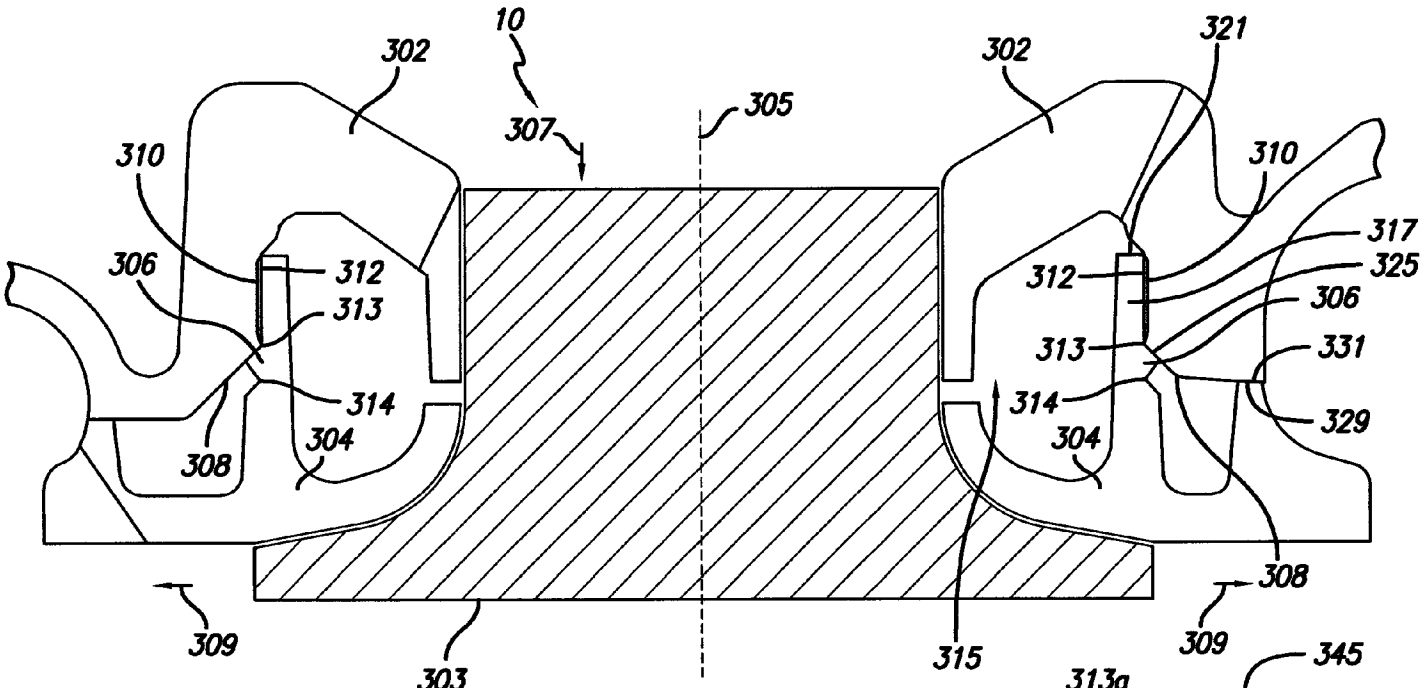
FIG. 3 is a sectional view of one embodiment of a turbocharger compressor housing comprising an annular projection and sealing features for enhancing the seal between a diffuser and compressor housing.

The apparatus 10, with reference to FIG. 3, can comprise a compressor housing portion 302 and a diffuser portion 304 coupled to the compressor housing portion. An impeller 303 is also shown in FIG. 3. Air enters the impeller as indicated by arrow 307 at a low pressure side of the impeller. Air exits the impeller, as indicated by arrows 309, at a high pressure side of the impeller. The compressor housing 302 and diffuser 304 are desirably annular so as to extend about the entire periphery of the impeller. In the illustrated FIG. 3 embodiment, the diffuser 304 and compressor housing 302 have a common longitudinal axis 305.

The illustrated compressor housing 302 defines an opening 315 into which a portion of the diffuser can be inserted. The opening has a pocket or chamber into which an insert portion of the diffuser can be positioned. More specifically, the illustrated compressor housing comprises a compressor housing wall 312. In the embodiment of FIG. 3, the wall 312 is annular and extends about the entire interior of the opening 315, which is also annular in this embodiment. The diffuser 304 comprises an insert or leg portion 317 comprising an exterior diffuser wall 310. In this embodiment, both the insert portion 317 and diffuser wall 310 can be annular. Portions of the walls 310, 312 are dimensioned to provide an interference fit between these components as indicated by the slightly overlapping spaced lines between walls 310 and 312 in FIG. 3.

The interfitting surfaces of the respective wall portions 310 and 312 can be designated as first and second mating surfaces. Although not required, desirably the mating surfaces each extend about the entire periphery of their respective components. Thus, when the diffuser 304 and compressor housing 302 are moved relative to one another to insert the insert portion 317 of the diffuser into the receiving opening 315, an interference fit between these mating surfaces is accomplished. Typically there is some galling or metal debris generated by the interference fitting (because these components are typically made of an aluminum alloy or other durable metal material, such as Alloy A380 aluminum alloy) This debris tends to collect proximate to the location where the insert portion 317 of the diffuser 304 first engages the compressor housing.

In the embodiment of FIG. 3, a recess or trench 313 is provided in the diffuser 304 spaced from the distal end 321 of the inserted portion of the diffuser with the interference fit being positioned between the distal end and the recess. Consequently, the recess collects the debris generated by the interfitting surfaces. In one form, the recess is annular and extends about the entire periphery of the insert portion 317 of the diffuser. Alternatively, the recess can be provided in wall 312 of the compressor housing (or in both wall 312 and wall 310) where it still functions to collect debris generated during the formation of the interference fit.

An annular projection 306 is also shown in FIG. 3. Projection 306 can project from the wall of the compressor housing 302 or, as shown in FIG. 3, from the exterior diffuser wall. In FIG. 3, the projection 306 comprises a ring and extends radially outwardly from the diffuser wall surface 310 toward the compressor housing wall. As the diffuser is inserted to its fully inserted position within the diffuser receiving opening 315 of the compressor housing 302, the projection 306 engages a portion of the wall 312 of the compressor housing to provide an annular seal or joint at the location of engagement.

During assembly of the components, the insert portion 317 of diffuser 304 is inserted into the diffuser receiving opening 315 slightly beyond the point of initial contact between the annular projection 306 and an engaged wall surface of the compressor housing, in this case wall surface 308 of the wall 312 of the compressor housing 302. For example, insertion can be 0.2 mm to 1.0 mm, and more desirably 0.7 mm, beyond the point of initial contact. As a result, the annular projection 306 is slightly deformed to provide enhanced sealing of the joint between the diffuser 304 and compressor housing 302.

A recess or trench 314, which also can be annular, is optionally provided adjacent to the projection 306, and spaced further from the distal end 321 than the projection, to provide a space into which a portion of the projection 306 can deform. In the embodiment of FIG. 3, the recesses 313, 314 and projection 306 are all included as part of the diffuser. The recess 313 collects debris generated during formation of the interference fit between the surfaces 310 and 312 and prevents (the term "prevents" includes substantially minimizes the risk of) this debris reaching the annular joint formed between the projection 306 and engaged wall portion 308 of the compressor housing.

As can be seen in FIG. 3, the wall portion 308 is provided with a first slope and thus comprises an annular sloped projection engaging surface. That is, the radius from axis 305 to a first location of wall surface 308 adjacent to the diffuser receiving opening is of a first dimension. In addition, the radius from the longitudinal axis 305 to the wall surface 308 and a second location spaced further from the diffuser receiving opening 315, is of a second dimension greater than the first dimension. As a result, a slope exists between the first and second locations. The sloping surface is desirably planar, although a sloping surface with a curvature or other shape can be used. One side 325 of the projection 306 comprises a compressor housing wall engaging surface portion of the projection and is positioned to engage a projection engaging wall portion of the surface 308. The surface 325 can also be sloped, for example as shown in FIG. 3. The sloped surface 325 can be deemed a second slope and desirably differs by no more than plus or minus 25 degrees from the first slope. Although variable, one specific example of the first slope is about 45 degrees. Desirably the second slope is greater than or the same as the first slope. If the second slope is greater than the first slope, an upper portion of the surface 325 will initially engage a portion of the surface 308 with the surface 325 becoming more fully engaged with the surface 308 following the initial contact between these surfaces as the diffuser moves to its fully inserted position.

In the embodiment of FIG. 3, the compressor housing comprises a stop surface 329, which can be annular. In addition, the diffuser can comprise a stop engaging surface 331, which can also be annular. These surfaces are positioned to engage one another when the diffuser wall insert portion 317 is at the fully inserted position as shown in FIG. 3. These surfaces thereby limit the extent of insertion of the diffuser into the diffuser receiving opening of the compressor housing and also limit the extent of insertion of the projection 306 into the diffuser receiving opening.

In the embodiment of FIG. 3, more effective sealing of the joint between wall surfaces 310 and 312 is thereby provided.

In the embodiment of FIG. 3, the projection 306 in effect comprises a metal gasket which is deflected or deformed during insertion of the diffuser fully into the compressor housing to enhance the sealing. This is accomplished without the need for o-ring seals between the diffuser and compressor housing. However, the use of o-ring seals are not precluded in combination with the sealing features described previously, although this would be a less desirable implementation.

The sealing features described above can be cast in a diffuser without machining. Alternatively, the features can be machined into the diffuser or diffuser receiving portions of the compressor housing. Because of manufacturing ease, it is more desirable to include the recess 313, projection 306 and recess 314, if used, on the diffuser. Although more than one projection can be used, in a more desirable implementation, only one such projection is included. An interference fit between the mating surfaces of walls 310, 312 in one desirable embodiment is achieved by having surface 310 be from about 0.1 mm to about 0.5 mm greater than the diameter of the surface 312. In addition, in one desirable embodiment, although variable, an interference fit having an approximately 9 mm length of engagement and extending about the entire periphery of the insert portion of the diffuser is employed.

Figure 3A:
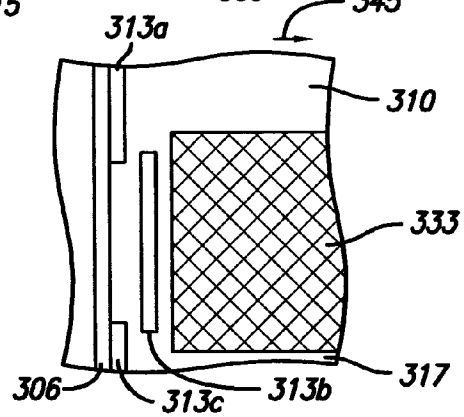
FIG. 3A is a partially broken away view showing an alternative form of sealing features.

In the embodiment of FIG. 3A, a portion of the insert portion 317 of an alternative diffuser embodiment is illustrated. In this embodiment, like elements to those of FIG. 3 are provided with like numbers. Although the compressor housing is not shown in FIG. 3A, a cross hatched region 333 is illustrated to indicate a location of interfering fit between a mating surface portion of the diffuser surface 310 and the corresponding mating surface of the compressor housing wall 312. In this example, although it could, mating surface 333 does not extend about the entire periphery of the wall 310. Instead, a plurality of such mating surfaces spaced apart from one another (one being shown in FIG. 3A) can be used to accomplish the interference fit. In addition, instead of an annular recess 313, recess segments 313*a*, 313*b* and 313*c* are illustrated. These segments can be discrete segments as shown or can be interconnected. Discrete segments can be more difficult to manufacture than a continuous annular recess and thus are less desirable. In the embodiment shown in FIG. 3A, the ends of segment 313*b* overlap respective ends of the segments 313*a* and 313*c*. As a result, when the diffuser insert 317 is inserted into the compressor housing (see the direction of arrow 345), which equivalently can be achieved by moving the compressor housing in the opposite direction to arrow 345 relative to the diffuser, the recesses 313*a*, 313*b* and 313*c* shield the projection 306 from debris generated during interfit of mating surface 333 with a corresponding mating surface of the compressor housing. That is, there is no direct path in a direction parallel to the axis of the diffuser between the mating surface area and the projection. Thus, the projection is shielded from such debris by the recesses 313*a*, 313*b* and 313*c*.

Figure 4:
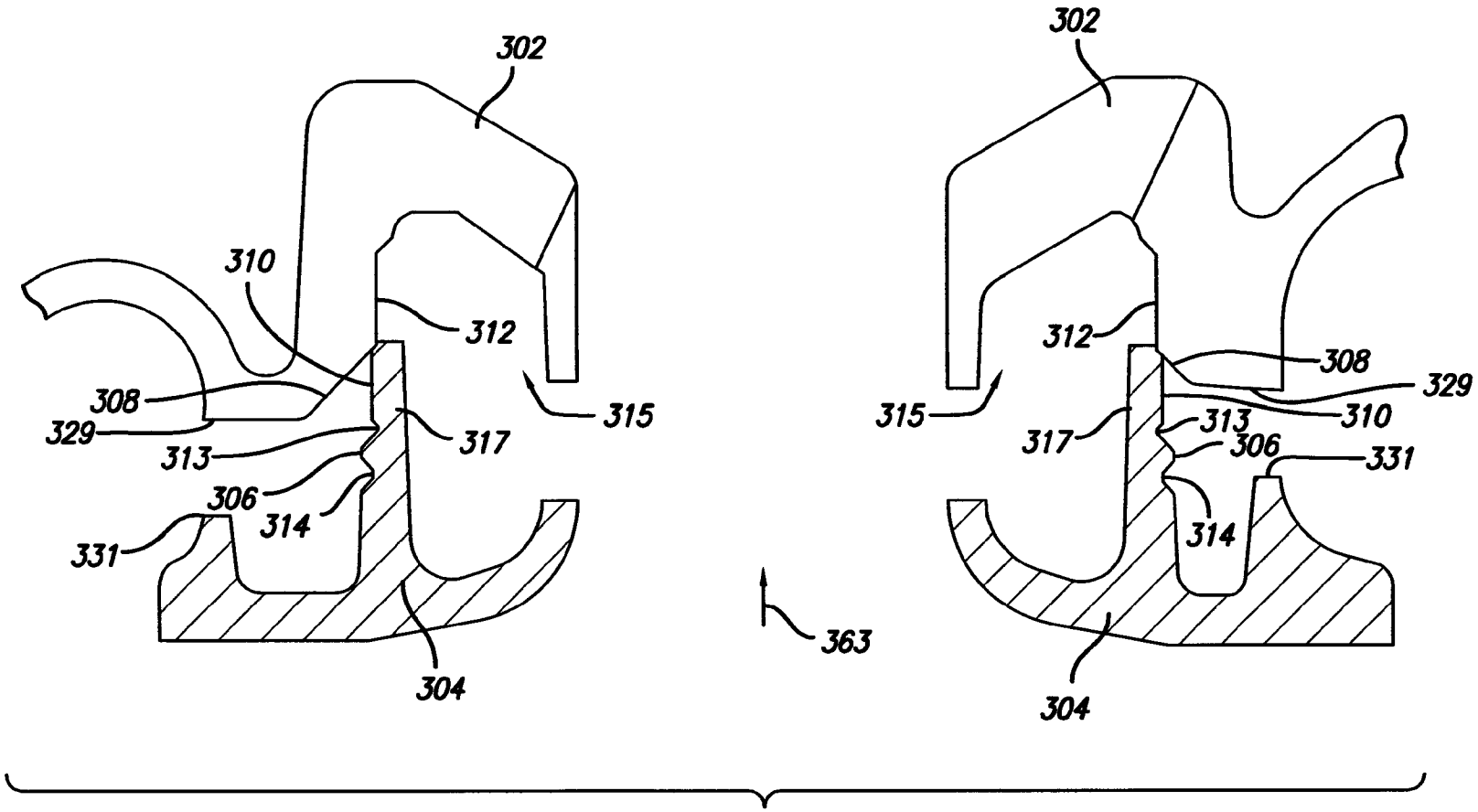
FIG. 4 illustrates a sectional view of an embodiment of a turbocharger compressor housing comprising a compressor housing and diffuser having sealing features with the diffuser being shown at a position of initial contact between the diffuser and compressor housing.
Figure 5:
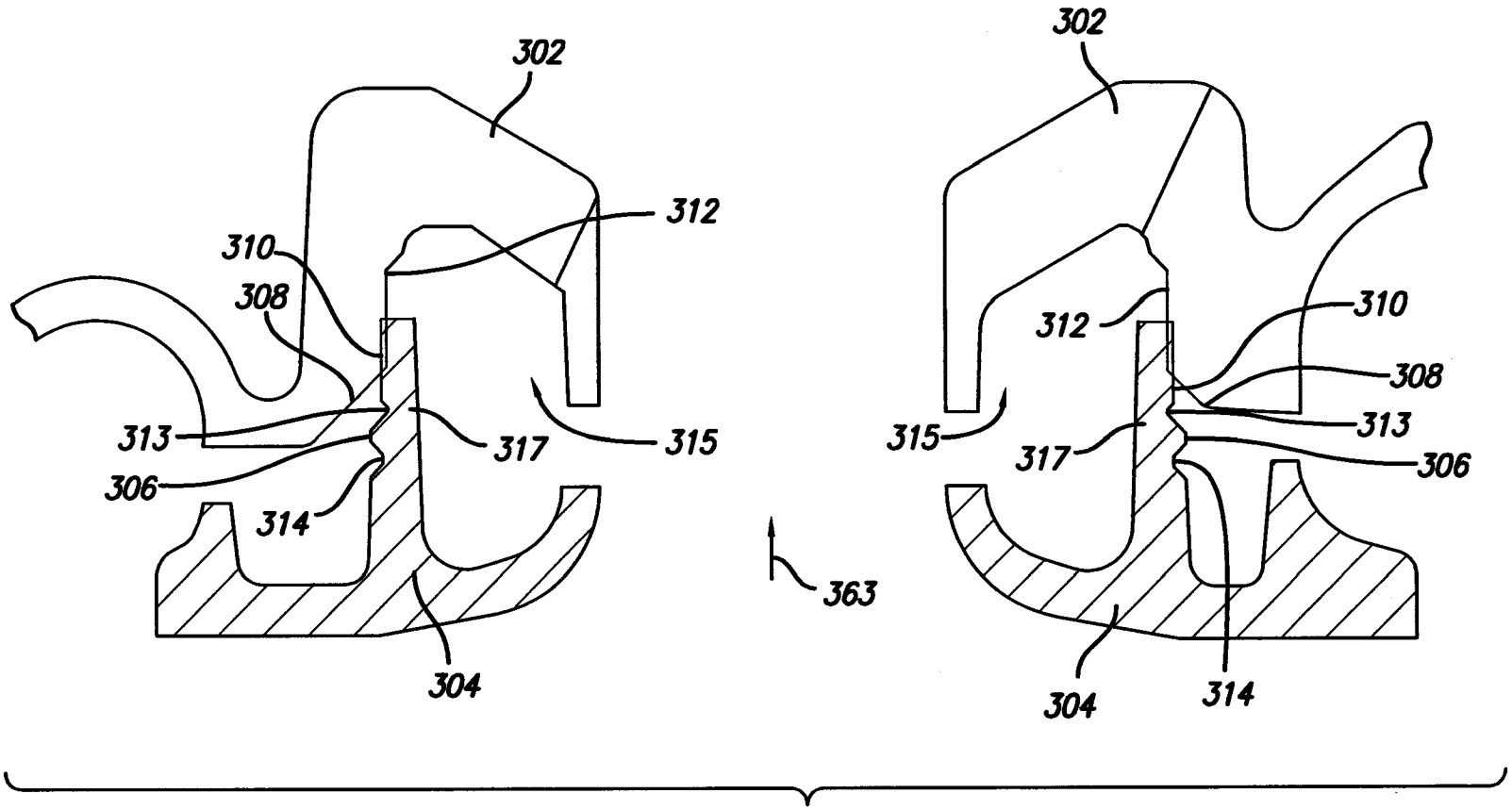
FIG. 5 is a sectional view of the embodiment of FIG. 4 with the diffuser being shown at an intermediate position of insertion into the compressor housing.
Figure 6:
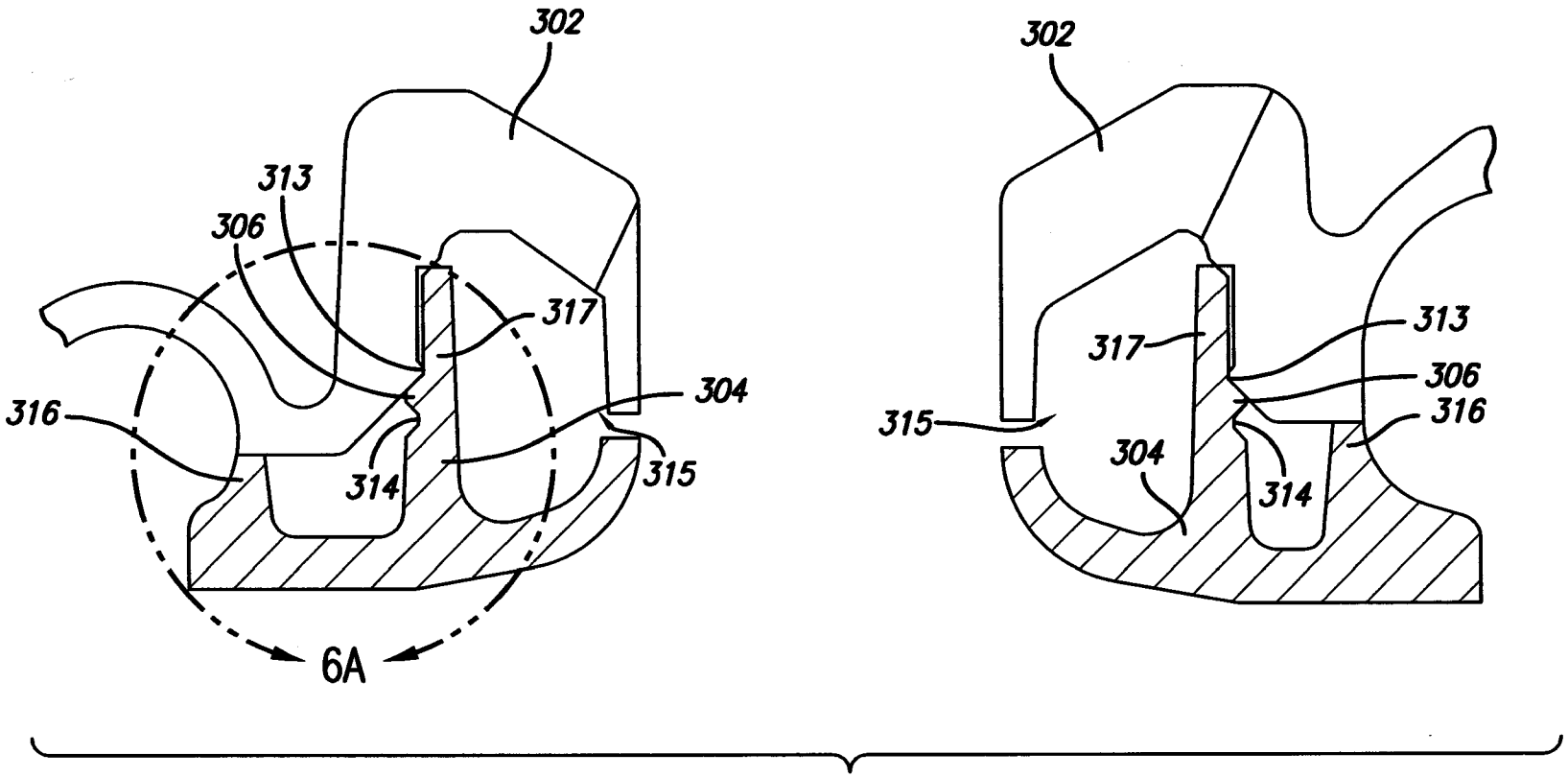
FIG. 6 is a sectional view of the embodiment of FIG. 4 showing the diffuser at a fully inserted position in the compressor housing.

FIG. 4 illustrates an alternative embodiment of a turbocharger housing apparatus with numbers used in FIG. 4 for like components shown in FIG. 3 being the same as the numbers in FIG. 3. In the FIG. 4 embodiment, the projection 306 is of a truncated generally triangular cross section as opposed to the generally triangular cross section of the projection 306 shown in FIG. 3. These are simply examples of suitable projections as other configurations of projections can be used. Projections in the form of an annular rib, such as shown in FIGS. 3 and 4, are desirable exemplary implementations. In FIG. 4, the components 302 and 304 are shown in a position where they initially contact one another with the diffuser insert 317 portion positioned within the diffuser receiving opening 315. Typically these components are press fit together. Although variable with the size of the components, exemplary pressures used in press fitting these components together are from 5,000 to 15,000 lbs. pressure. Relative movement of the diffuser 304 to the compressor housing 302 is indicated by arrow 363 in FIG. 4. FIG. 5 illustrates the FIG. 4 compressor housing 302 and diffuser 304 with the diffuser 304 inserted into the compressor housing to an intermediate extent. FIG. 6 illustrates the FIG. 4 embodiment with the diffuser fully inserted into the compressor housing.

Figure 6A:
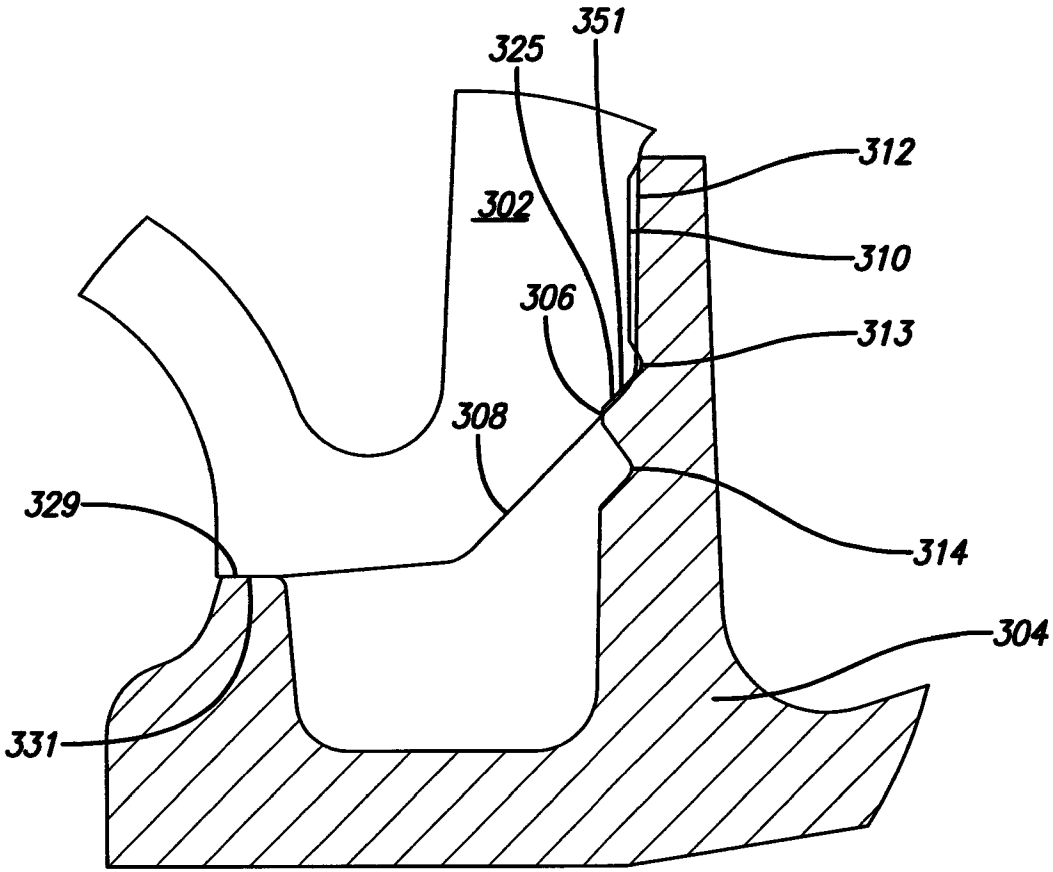
FIG. 6A is an enlarged view of a portion of the embodiment of FIG. 6 indicated by the broken or dashed circle labeled 6A in FIG. 6.

FIG. 6A is an enlarged view of a portion of the embodiment shown in FIG. 6. The deformation of the projection 306 is indicated schematically at 351 by a portion of the wall surface 325 overlapping a portion of the wall surface 308. The area 351 comprises an annular joint between the projection 306, and more specifically between wall surface 325 of the projection 306 and the wall surface 308 of the compressor housing 302.

Again, one or more of the projection and recess or trench features described above as being formed on the diffuser 304 can alternatively be implemented in a corresponding region of the compressor housing 302.

Figure 2A:
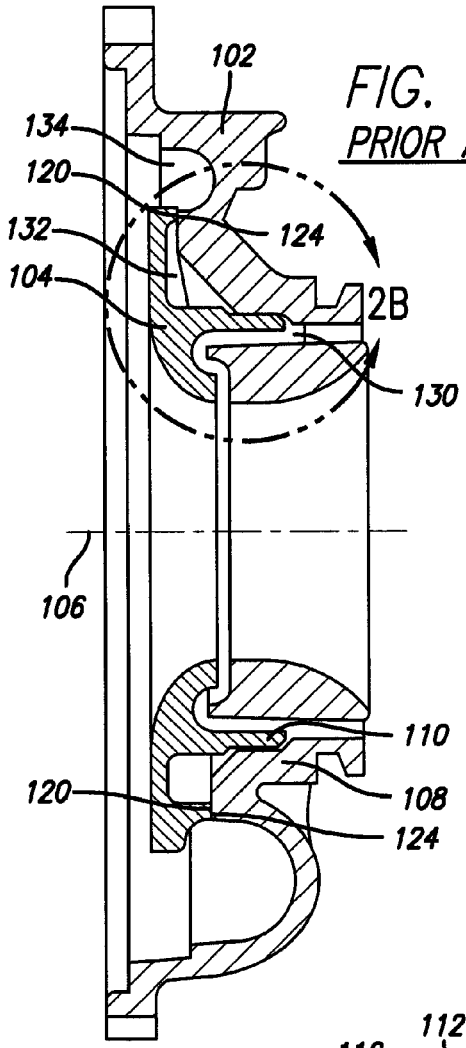
FIG. 2A PRIOR ART
FIG. 2A is a vertical sectional view of a prior art turbocharger compressor housing comprising a compressor housing and a diffuser.
Figure 2B:
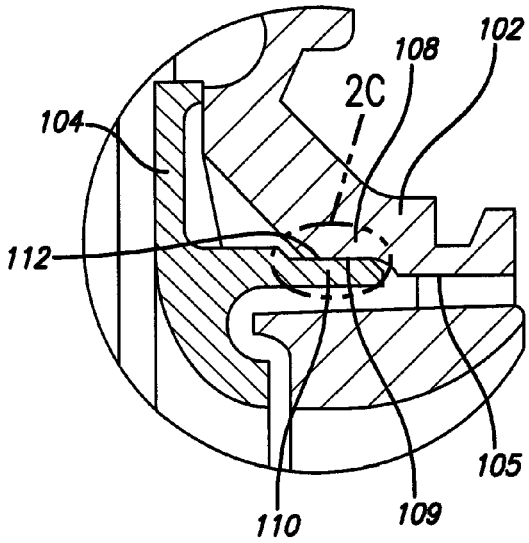
FIG. 2B PRIOR ART
FIG. 2B is an enlarged view of a portion of the embodiment of FIG. 2A indicated by a broken or dashed circle labeled 2B in FIG. 2A.
Figure 2C:
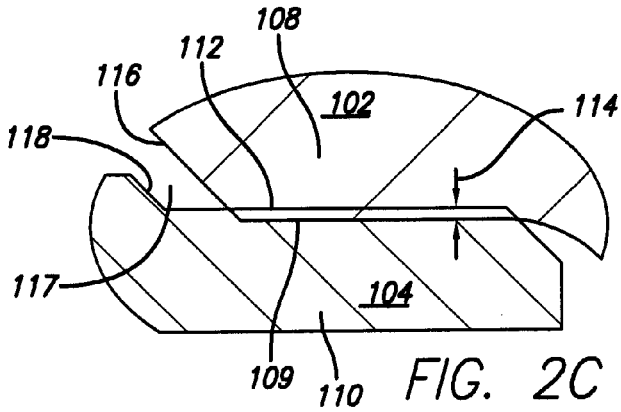
FIG. 2C PRIOR ART
FIG. 2C is an enlarged view of a portion of the embodiment of FIG. 2B indicated by a broken or dashed circle labeled 2C in FIG. 2B.

Turbocharger compressor housings having a projection and recess or trench configurations as described above significantly reduce leakage between the high-pressure and low-pressure passages in comparison to the leakage of a prior art device of the type shown in FIG. 2. For example, a test of two turbocharger housings of the type shown in FIG. 2 found leakage of from 40 to 50 liters per minute (L/min.) across the interference joint between high and low pressure areas. The use of o-ring seals can reduce this leakage to about zero, but o-ring seals are more complex to implement.

Figure 7:
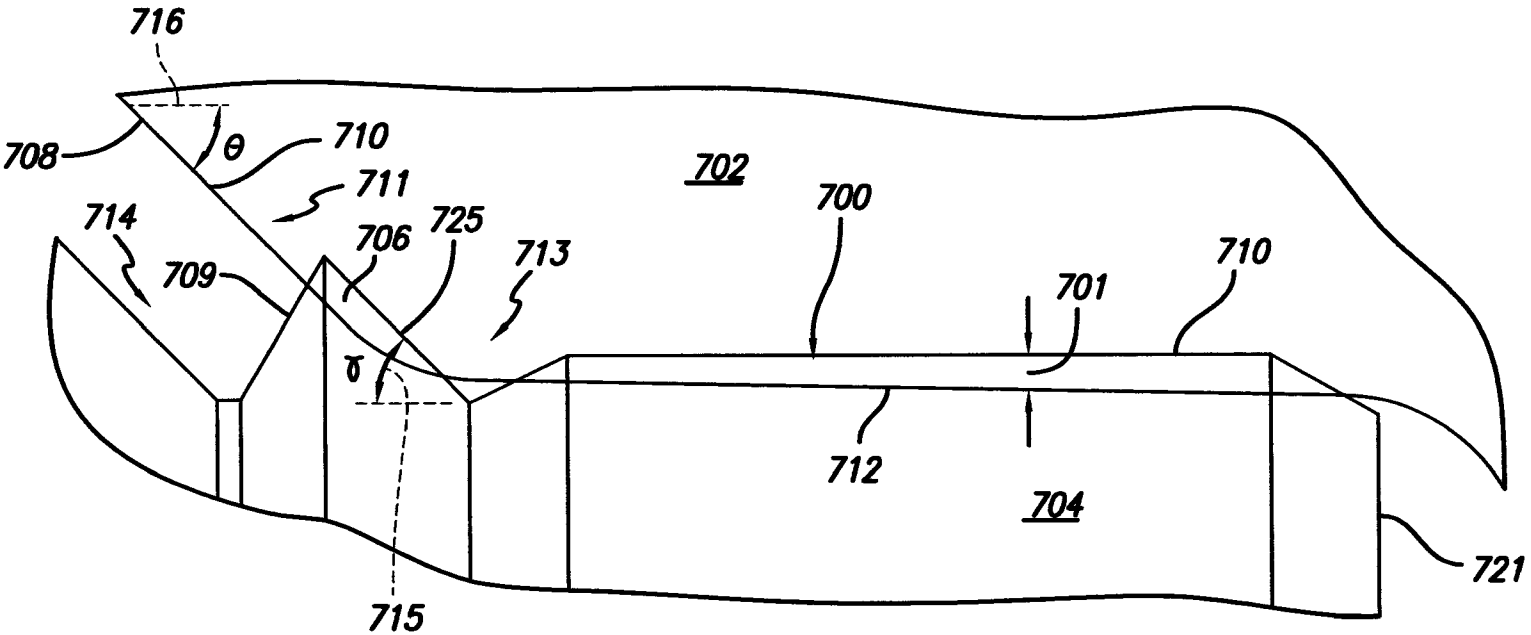
FIG. 7 is a partially broken away view of a compressor housing and diffuser showing an embodiment of sealing features incorporated into the diffuser.
Figure 8:
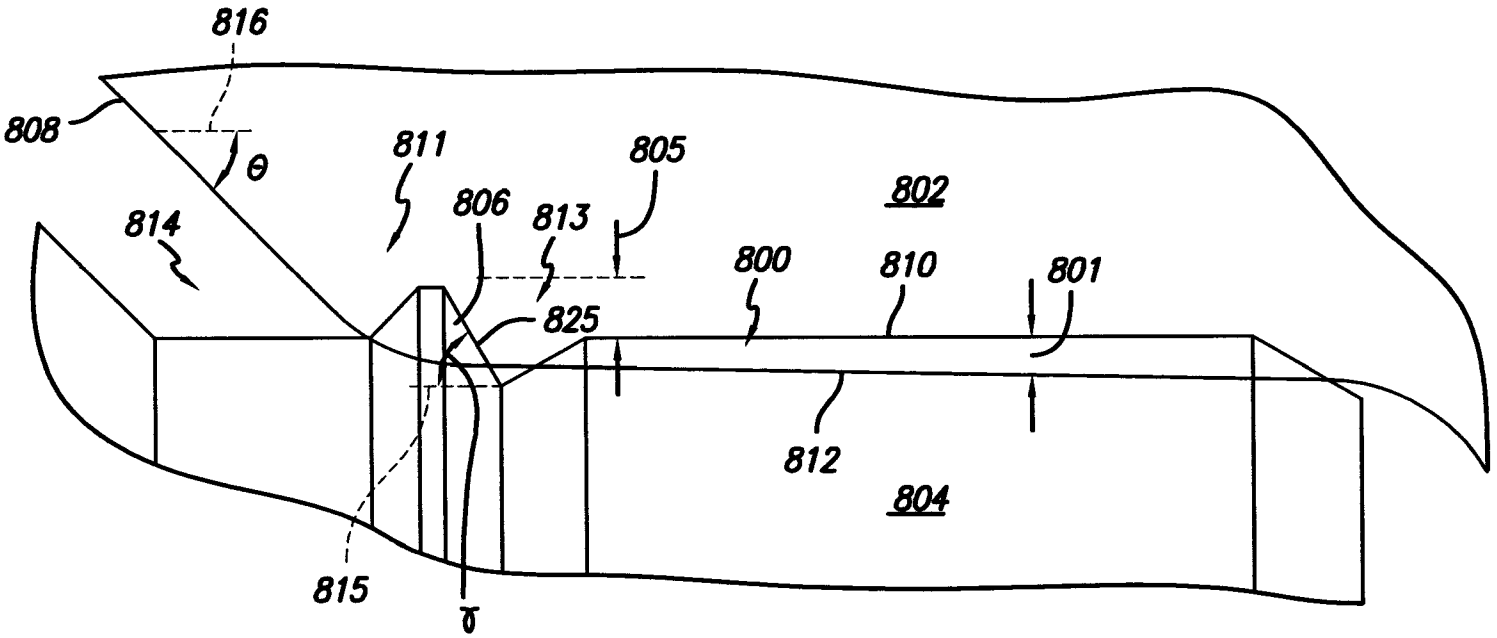
FIG. 8 illustrates an embodiment with an alternative form of sealing features.
Figure 9:
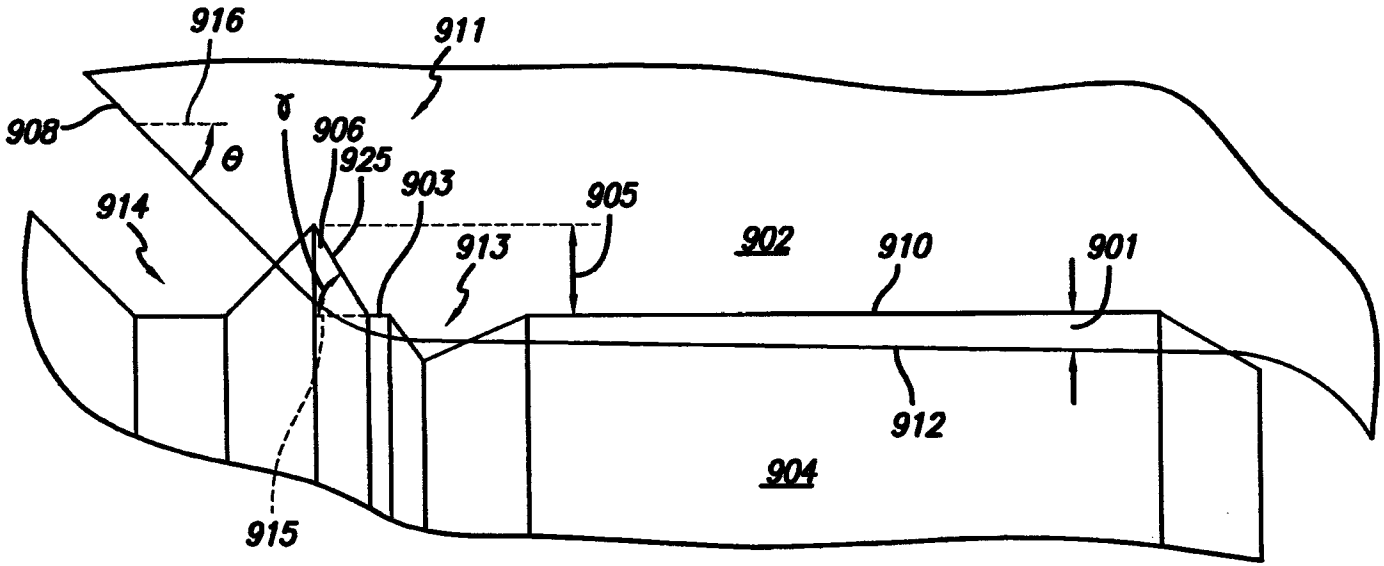
FIG. 9 illustrates an embodiment with yet another form of sealing features.

In the embodiments of FIGS. 7, 8 and 9, elements corresponding to elements of the FIGS. 3 and 4 embodiments have been assigned the same numbers except that in FIG. 7 the numbers start with 7 instead of 3 (e.g. 306 becomes 706), in FIG. 8 the numbers start with 8 (e.g. 306 becomes 806 in FIG. 8), and in FIG. 9 the numbers start with 9 (e.g. 306 becomes 906). The following description of these embodiments focuses on the differences between these embodiments.

FIG. 7 illustrates a region of engagement 700 between an assembled compressor housing 702 and a diffuser 704. As in the embodiment described with respect to FIG. 3, the housing 702 and diffuser 704 are engaged using an annular interference fit between an inner wall 712 of the housing 702 and an outer wall 710 of the insert 704. The length of the interference fit was 9 mm in this example. At the illustrated region of engagement 700, the radius of the outer wall 710 from a longitudinal axis of the assembly (not shown, but like the longitudinal axis 305 shown in FIG. 3) exceeds the radius of the inner wall 712 by a distance 701, which in this example is 1 mm. The outer wall 710 defines an annular leading trench or recess 713 for collecting debris resulting from the interference engagement between the housing 702 and the insert 704. The insert 704 defines an annular projection 706 and a trailing annular trench or recess 714 adjacent the projection to at least partially receive the deformed portion of the projection. Recess 714 is further from distal end 721 of the insert portion of the diffuser than the projection 706 and is at the opposite side of the projection than the recess 713.

The housing 702 defines a diverging region 711 and a surface 708. The wall 710 diverges radially from the longitudinal axis in the region 711 moving in a direction away from the base of the diffuser receiving opening. The surface 708 forms an angle θ relative to a line 716 parallel to the longitudinal axis. In the specific embodiment shown, θ is forty five degrees.

In the illustrated embodiment, the leading edge 725 of the rib 706 adjacent the leading trench 713 diverges or slopes at an angle γ from a line 715 parallel to the longitudinal axis. Although the slopes θ and γ can vary as previously explained, in this example the slopes are the same. Although variable, the projection 706 is triangular in cross section in this example and has a height of 1 mm. The slope of the trailing surface 709 in this example is greater than the slope γ. In this example, the diffuser is inserted into the compressor housing 0.7 mm beyond the initial contact of the projection with the compressor housing surface. Testing of three sample turbocharger compressor housings of the FIG. 7 form determined leakage of respectively 0.5 L/min., 3.0 L/min. and 0.3 L/min. across the joint between the diffuser and compressor housing.

FIG. 8 illustrates another embodiment of an assembled compressor housing 802 and a diffuser 804 having an annular region of interfit engagement 800 that is like the interference fit 700 of the example of FIG. 7.

In the FIG. 8 embodiment, when inserted into its final position, the projection 806 extends axially a greater extent (e.g., 2.0 mm) into the housing 802 beyond its initial point of contact with the housing than the extent of penetration into the housing of the projection 706 in the example of FIG. 7. In the FIG. 8 embodiment, the projection 806 is generally triangular in cross section, but has a truncated apex. The height 805 of the projection, although variable, in this example is 0.5 mm from the base of the projection (substantially in line with surface 810) to the top of the truncated apex. The slope of surface 825 in this example is greater than the slope of surface 725 in FIG. 7. More specifically, the slope of surface 825 in the FIG. 8 example is sixty degrees.

The housing and diffuser in FIG. 8 are engaged using an interference fit between an inner wall 812 of the housing and an outer wall 810 of the insert. The overlap distance 801 in FIG. 8 example is like the distance in the FIG. 7 example, namely 1 mm. The outer wall 810 defines a leading trench or recess 813 for collecting debris resulting from the interfit engagement between the housing and the insert. The diffuser 804 also includes the projection 806 and a trailing trench 814 adjacent to the projection to at least partially receive the projection in its deformed condition (not shown). The slope θ of surface 808 in this example is also forty-five degrees, although this can be varied. The trailing trench 814 in this FIG. 8 embodiment is shallower than the trailing trench 714 in the embodiment of FIG. 7. Testing of three sample turbocharger compressor housings of the FIG. 8 form determined leakages of respectively 12.0 L/min., 7.5 L/min., and 8.5 L/min. across the joint between the diffuser and compressor housing.

FIG. 9 illustrates another embodiment of an assembled compressor housing 902 and a diffuser 904. As in the FIGS. 7 and 8 embodiments, the housing and insert are engaged using an annular interference fit indicated at 900 like the interference fit 700 of the FIG. 7 example and having an interference depth 901 of 1 mm.

This embodiment differs from the FIG. 7 embodiment because the angle γ (the slope of surface 925) is steep relative the slope of surface 908, indicated by the angle θ (e.g., θ in FIG. 9 is forty-five degrees). In the FIG. 9 example, γ is sixty degrees. The height 905 of the projection is one mm in this example.

The exterior or outer diffuser wall 910 again defines a leading recess or trench 913 for collecting debris. The diffuser 904 also defines an annular projection 906 and a trailing trench 914. In the embodiment of FIG. 9, the leading trench is axially spaced from the leading edge of the rib by a small distance to provide an annular right cylindrical region 903. Testing of three sample turbocharger compressor housings of the FIG. 9 form determined leakages of respectively 0.7 L/min., 3.6 L/min., and 6.5 L/min across the joint between the diffuser and compressor housing.

Thus, the examples described above illustrate the enhanced sealing achieved by embodiments in accordance with this disclosure.

The embodiments disclosed herein are examples provided to illustrate the inventive concepts and are not taken as limiting. In this disclosure, use of the singular, such as "a" or "an", or "first" includes the plural unless otherwise expressly designated. Thus, for example, if two or more of an element is provided, "an" or "a" element also exists. Also, if tow or more of an element are provided, a "first" of such elements also exists.

Having illustrated and described the principals of our invention with reference to a number of illustrative embodiments, it should be apparent to those of ordinary skill in the art that these embodiments may be modified in arrangement and detail without departing from the principals described herein. We claim as our invention all embodiments that fall within the scope of the following claims.

We claim:

1. A turbocharger compressor housing apparatus comprising:

a compressor housing comprising a diffuser receiving opening bounded at least in part by a compressor housing wall that comprises a first mating surface;

a diffuser comprising an exterior diffuser wall that comprises a second mating surface, the exterior diffuser wall being sized and shaped for insertion into the diffuser receiving opening to a fully inserted position;

the first and second mating surfaces being configured to provide an interference fit of the compressor housing wall and the exterior diffuser wall at least when the exterior diffuser wall is inserted into the diffuser receiving opening to the fully inserted position, the diffuser comprising a distal end positioned within the diffuser receiving opening;

one of the compressor housing wall and the exterior diffuser wall comprising an annular projection extending outwardly from the said one of the compressor housing wall and the exterior diffuser wall and toward the other of the compressor housing wall and the exterior diffuser wall;

the projection being positioned to engage said other of the compressor housing wall and the exterior diffuser wall to form an annular joint between the projection and engaged said other of the compressor housing wall and exterior diffuser wall at least when the exterior diffuser wall is at the fully inserted position; and one of the compressor housing wall and the exterior diffuser wall comprising a recess positioned adjacent to a first side portion of the projection, the recess being nearer to the distal end portion than the first side portion of the projection and positioned to prevent debris generated by the interference fitting of the first and second mating surfaces from reaching the annular joint.

2. An apparatus according to claim 1 wherein said one of the compressor housing wall and the exterior diffuser wall comprises a second recess positioned adjacent to a second side of the projection, the projection being positioned between the second recess and the distal end portion.

3. An apparatus according to claim 2 wherein the projection, the first recess, and the second recess all comprise portions of the exterior diffuser wall.

4. An apparatus according to claim 1 wherein there is only one projection.

5. An apparatus according to claim 1 wherein the first and second recesses are annular.

6. An apparatus according to claim 1 wherein the first and second mating surfaces comprise cylindrical mating surfaces.

7. An apparatus according to claim 1 wherein the first and second mating surfaces comprise right cylindrical mating surfaces.

8. An apparatus according to claim 1 wherein the said one of the compressor housing wall and the exterior diffuser housing wall is the exterior diffuser housing wall.

9. An apparatus according to claim 1 wherein the compressor housing comprises a longitudinal axis, the first mating surface comprising a right cylindrical mating surface portion of the compressor housing wall that is coaxial with the longitudinal axis, the compressor housing wall comprising an annular projection engaging wall portion adjacent to the diffuser receiving opening, the annular projection engaging wall portion having a first radius from the longitudinal axis at a first location adjacent to the diffuser receiving opening and a second radius from the longitudinal axis at a second location spaced further from the diffuser receiving opening than the first location, the second radius being greater than the first radius, the annular projection engaging wall portion having a first slope from the first location to the second location, wherein the diffuser comprises the projection and wherein the projection comprises an annular compressor housing wall engaging surface portion at a first side portion of the projection that has a second slope, the first side portion of the projection being nearest to the distal end, the compressor housing wall engaging surface portion of the projection engaging the projection engaging wall portion to form the annular joint at least when the exterior diffuser wall is at the fully inserted position.

10. An apparatus according to claim 9 wherein the second slope is differs by no more than plus or minus twenty-five degrees from the first slope.

11. An apparatus according to claim 9 wherein the second slope is greater than the first slope.

12. An apparatus according to claim 9 wherein the second slope is the same as the first slope.

13. An apparatus according to claim 9 wherein the first slope is about forty-five degrees.

14. An apparatus according to claim 9 wherein the diffuser comprises a second recess positioned adjacent to a second side portion of the projection spaced further from the distal end than the first side portion of the projection.

15. An apparatus according to claim 14 wherein both the first and second recesses are annular and are included on the diffuser.

16. An apparatus according claim 9 wherein the diffuser is press fit into the diffuser receiving opening with the projection being inserted into the diffuser receiving opening from 0.2 mm to 1 mm beyond the initial contact between the projection engaging wall portion and the compressor housing wall engaging surface portion when the exterior diffuser wall is at the fully inserted position.

17. An apparatus according to claim 1 wherein the compressor housing comprises a stop surface and the diffuser comprises a stop engaging surface, the stop surface and stop engaging surfaces being positioned to engage one another when the exterior diffuser wall is at the fully inserted position to limit the extent of insertion of the diffuser into the diffuser receiving opening of the compressor housing and to limit the extent of insertion of the projection into the diffuser receiving opening.

18. An apparatus according to claim 1 wherein there are no o-ring seals between the compressor housing and the diffuser.

19. A turbocharger compressor housing apparatus comprising:

a diffuser comprising a diffuser body with an exterior wall, the exterior wall comprising a compressor housing mating surface and a distal end;

an annular at least partially deformable projection extending outwardly from the exterior wall; and the mating surface defining a first recess positioned adjacent to the projection, the recess being positioned between the projection and mating surface and sized to span the mating surface so as to shield the projection from the mating surface.

20. An apparatus according to claim 19 wherein the diffuser body defines a second recess positioned further from the distal end than the projection.

21. An apparatus according to claim 20 wherein the first and second recesses are each annular.

22. An apparatus according to claim 19 wherein the diffuser comprises a longitudinal axis and wherein the mating surface is of a right cylindrical shape having a longitudinal axis aligned with the longitudinal axis of the diffuser.

23. An apparatus according to claim 19 wherein the projection is generally triangular in cross section with an apex of the triangle being spaced from the exterior wall.

24. An apparatus according claim 23 wherein the apex is truncated.

25. An apparatus according to claim 23 wherein the projection comprises a sloping surface portion at a side of the projection nearest to the distal end.

26. An apparatus according to claim 25 wherein the sloping surface portion has a slope of from twenty degrees to seventy degrees.

27. A method of engaging a turbocharger compressor housing and a diffuser comprising:

sliding the compressor housing and diffuser relative to one another to insert the diffuser into the compressor housing and to form an interference fit of the diffuser to the compressor housing;

at least partially deforming an annular projection included in one of the compressor housing and diffuser during sliding of the compressor housing and diffuser relative to one another to form an annular joint between the housing and diffuser; and collecting debris generated during the interference fit and preventing the debris from reaching the annular joint.

28. The method of claim 27 wherein the act of at least partially deforming the annular projection comprises collapsing at least a portion of the annular projection into an annular recess.

29. A turbocharger compressor housing apparatus comprising:

a compressor housing having a first cylindrical region comprising a first mating surface;

a diffuser comprising a distal end, the diffuser also comprising a second cylindrical region comprising a second mating surface matingly engaged with the first mating surface to form an interference fit therebetween; and an at least partially collapsed annular projection extending outwardly from one of the compressor housing and diffuser and positioned so as to engage the other of the compressor housing and diffuser to form an annular metal gasket to at least partially seal the joint between the first and second mating surfaces, wherein at least one of the first mating surface and the second mating surface defines a first annular recess between the projection and the distal end and a second annular recess adjacent to the projection and further from the distal end than the projection.

* * * * *